US008800276B2

(12) United States Patent
Levin et al.

(10) Patent No.: US 8,800,276 B2
(45) Date of Patent: Aug. 12, 2014

(54) MIXING SYSTEM

(75) Inventors: Michael Levin, Ann Arbor, MI (US); Furqan Zafar Shaikh, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 232 days.

(21) Appl. No.: 13/419,978

(22) Filed: Mar. 14, 2012

(65) Prior Publication Data

US 2013/0239546 A1 Sep. 19, 2013

(51) Int. Cl.

| | |
|---|---|
| ***F01N 1/00*** | (2006.01) |
| ***F01N 3/00*** | (2006.01) |
| ***F01N 3/10*** | (2006.01) |
| ***B05B 7/10*** | (2006.01) |
| ***F01N 3/28*** | (2006.01) |
| ***B01F 5/04*** | (2006.01) |

(52) U.S. Cl.

CPC ..... *F01N 3/2892* (2013.01); *F01N 2240/20* (2013.01); *F01N 2610/02* (2013.01); *F01N 2610/1453* (2013.01); *B01F 5/04* (2013.01); *B01F 5/0473* (2013.01)

USPC ..... 60/324; 60/295; 60/303; 261/79.2

(58) Field of Classification Search

CPC ..... F01N 3/206; F01N 3/2066; F01N 3/2892; F01N 2240/20; F01N 2610/02; F01N 2610/1453; B01F 5/04; B01F 5/0451; B01F 5/0473

USPC ..... 60/295, 301, 303, 311, 324; 239/501; 261/79.1, 79.2, 108

See application file for complete search history.

(56) References Cited

U.S. PATENT DOCUMENTS

| | | | | |
|---|---|---|---|---|
| 5,971,847 | A * | 10/1999 | Webb | 454/290 |
| 7,896,645 | B2 | 3/2011 | Loving | |
| 7,963,104 | B2 | 6/2011 | Girard et al. | |
| 2008/0047260 | A1 | 2/2008 | Kapsos et al. | |
| 2009/0019843 | A1 * | 1/2009 | Levin et al. | 60/303 |
| 2010/0107614 | A1 | 5/2010 | Levin et al. | |
| 2011/0067381 | A1 * | 3/2011 | Zimmerman et al. | 60/273 |
| 2011/0162348 | A1 | 7/2011 | Kim et al. | |
| 2012/0011837 | A1 * | 1/2012 | Navathe et al. | 60/324 |

* cited by examiner

*Primary Examiner* — Audrey K Bradley

(74) *Attorney, Agent, or Firm* — Julia Voutyras; Alleman Hall McCoy Russell & Tuttle LLP

(57) ABSTRACT

A mixing system is provided. The mixing system includes a housing defining a boundary of a mixing conduit including an expansion section with an injector mount and a reductant diverter extending into the conduit upstream of the injector mount in the expansion section. The mixing system further includes an atomizer with openings positioned in the housing and a helical mixing element positioned in the housing.

17 Claims, 7 Drawing Sheets

MIXING SYSTEM

BACKGROUND/SUMMARY

Internal combustion engines utilize emission control devices to reduce emissions from the engine. The emission control devices may be filters, catalysts, and other suitable device for removing unwanted gases, particulates, etc., from an engine exhaust stream. Some emission control devices inject reductants, such as urea or ammonia, into the exhaust system upstream of a catalyst to convert nitrogen oxides into diatomic nitrogen, water, etc., to reduce the amount of nitrogen oxides released to the atmosphere. The reductant spray and the catalyst work in conjunction to enable nitrogen oxide conversion.

To aid in nitrogen oxide conversions in the catalyst, various approaches are provide to mix the reductant spray in the exhaust stream to promote even distribution of the reductant. One approach is described in US 2010/0107614 using various mixing devices with a specific injector configuration.

The inventors herein have recognized some disadvantages of the above approach related not only to manufacturability, but also to how the various features work together in combination. In addition to packaging and manufacturability issues, the overall flow path and mixing interactions between the injector and various mixing devices along the exhaust flow path can result in unintended consequences that degrade overall atomization under certain temperature and flowrate conditions.

To address at least some of these issues, one approach provides a mixing system. The mixing system includes a housing defining a boundary of a mixing conduit including an expansion section with an injector mount and a reductant diverter extending into the conduit upstream of the injector mount in the expansion section. The mixing system further includes an atomizer with openings positioned in the housing and a helical mixing element positioned in the housing.

The atomizer may decrease the size of the reductant droplets in the exhaust stream and work in cooperation with the diverter positioned in the expansion region. Because the expansion region enables a reduction in pressure and flow velocity, the diverter takes advantage of the change in flow conditions to aid in the injector droplet mixing where the atomizer, being at the end of the expansion region in one example, can then further enhance the mixing and prepare it for entrance into the downstream helical mixing region. As a result, nitrogen oxide conversion in a catalyst positioned downstream of the mixing system may be improved. Thus, not only does the helical mixing element increase the turbulence in the exhaust gas and promote more even distribution of the reductant spray in the exhaust gas, it does so with a mixture that has been especially prepared for such an operation. It will be appreciated that the atomizer and helical mixing element work in conjunction with the expansion region and diverter to promote mixing of the reductant spray in the exhaust stream to improve operation of a downstream catalyst.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 2-9 and 11 are drawn approximately to scale, although modifications may be made, if desired.

DETAILED DESCRIPTION

A mixing system is described including a diverter positioned upstream of a reductant injection nozzle, an atomizer positioned downstream of the diverter and the injection nozzle, and a helical mixing element positioned downstream of the atomizer. The aforementioned components of the mixing system may work in conjunction to increase turbulence of the exhaust gas and reduce the size of the reductant vapor particles in the exhaust gas to improve operation of a catalyst positioned downstream of the mixing system. In this way, engine emissions can be reduced.

Figure 1:
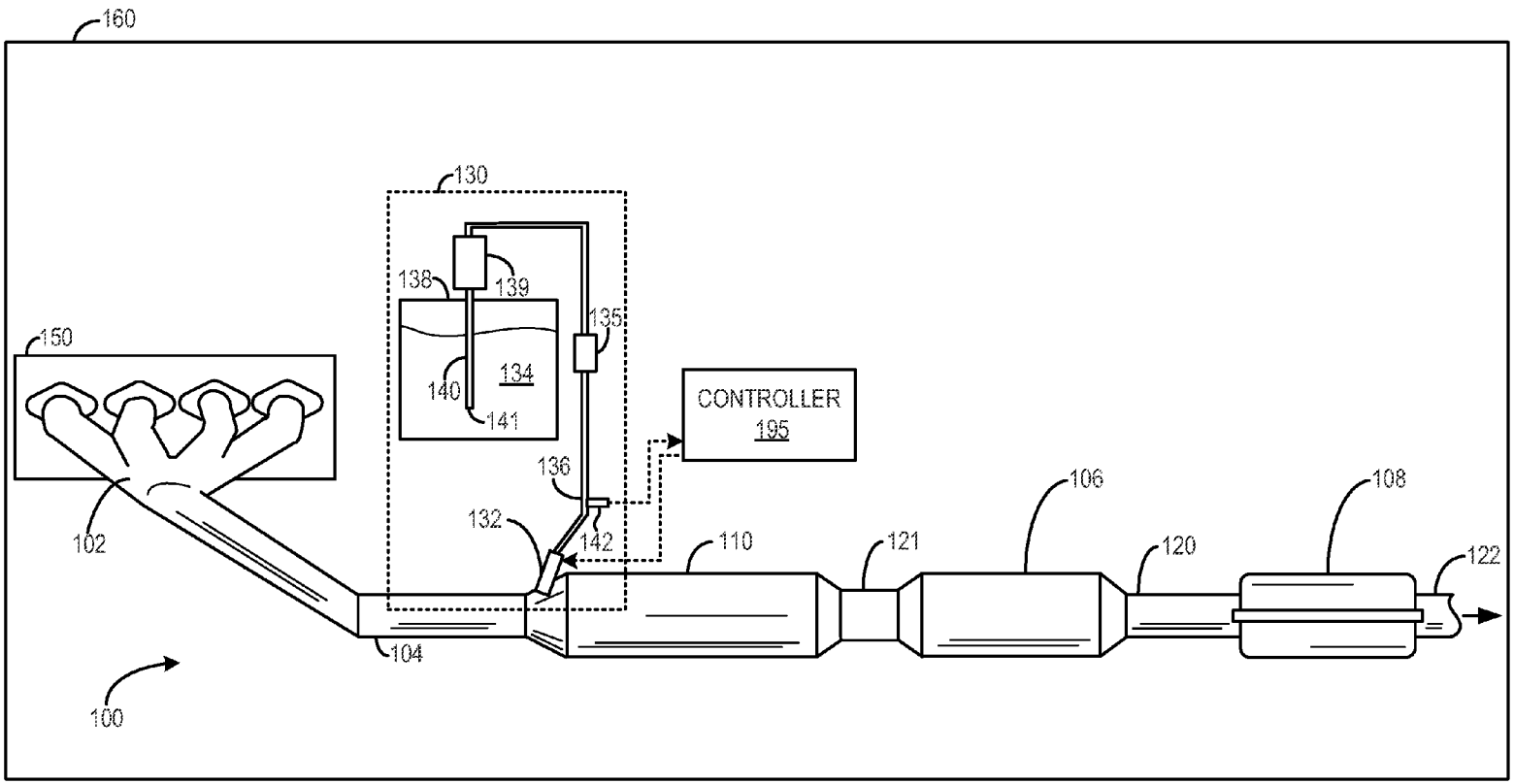
FIG. 1 shows a schematic depiction of a vehicle having a reductant injection system.
Figure 2:
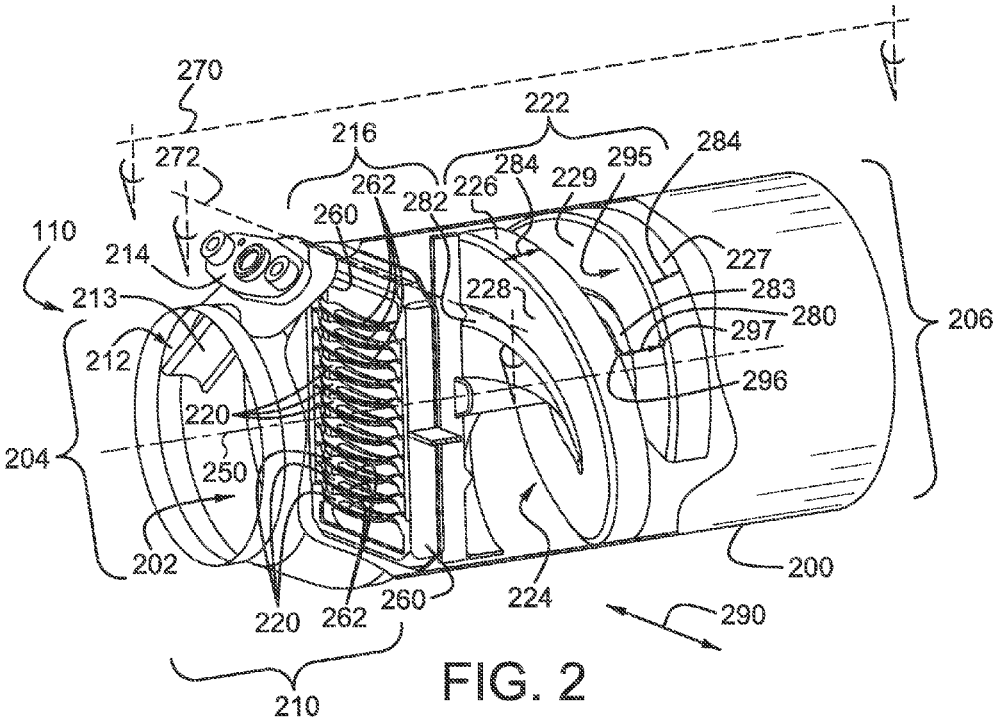
FIG. 2 shows an illustration of an example mixing system included in the vehicle shown in FIG. 1.
Figure 3:
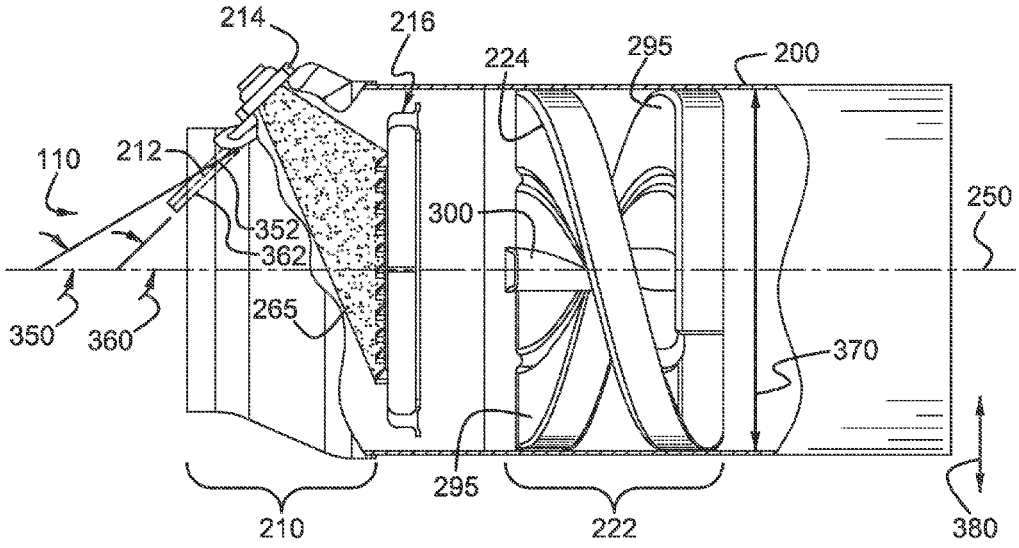
FIG. 3 shows a cross-sectional side view of the mixing system shown in FIG. 3.
Figure 4:
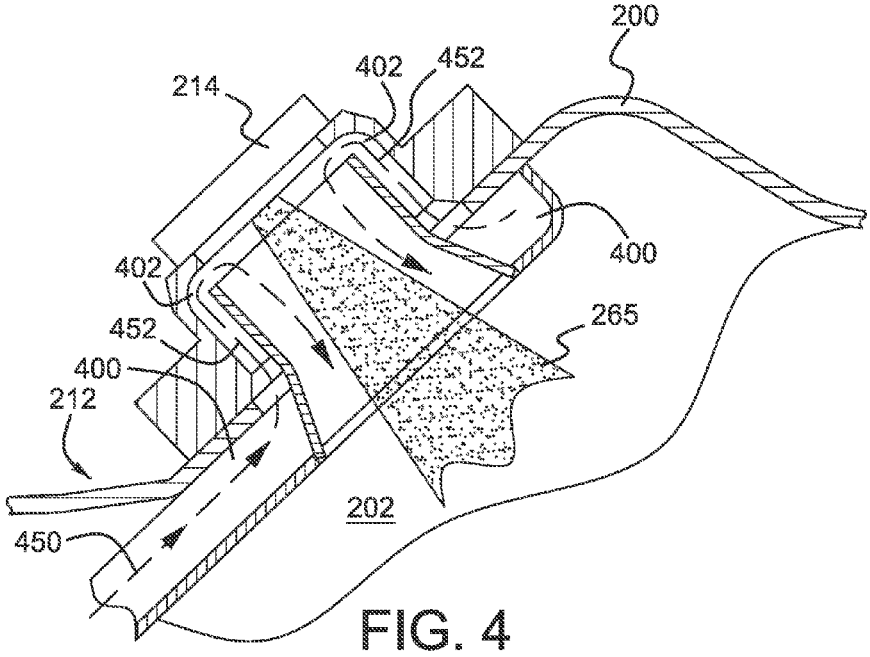
FIG. 4 shows an expanded view of the diverter included in the mixing system shown in FIG. 3.
Figure 5:
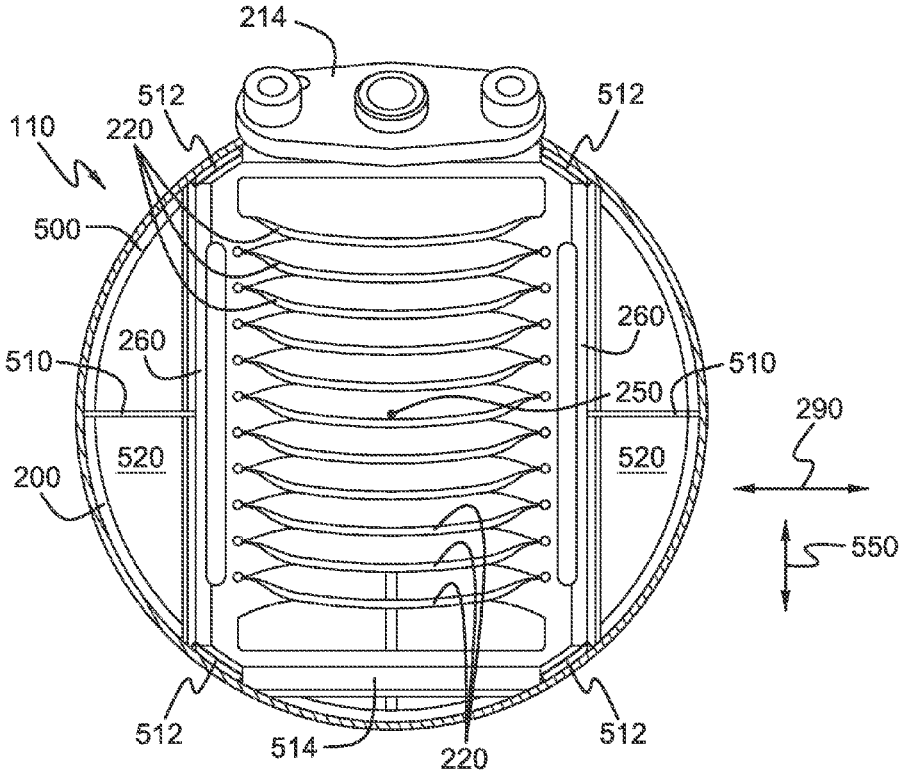
FIG. 5 shows another cross-sectional view of the mixing system shown in FIG. 2.

FIG. 1 includes an example exhaust system for a vehicle with an engine including a reductant injection system. FIG. 2 shows an embodiment of a mixing system included in the vehicle shown in FIG. 1. FIG. 3 shows a side view of the mixing system shown in FIG. 2. FIG. 4 shows a side cross-sectional view of the injection in the expansion region. FIG. 5 shows details of an example atomizer, and FIGS. 6-9 and 11 show details of a double-helix-shaped mixing element. FIG. 10 includes a flow chart of an example method for operating a reductant injection system.

More specifically, FIG. 1 illustrates an exhaust system 100 for transporting exhaust gases produced by internal combustion engine 150. As one non-limiting example, engine 150 includes a diesel engine that produces a mechanical output by combusting a mixture of air and diesel fuel. Alternatively, engine 150 may include other types of engines such as gasoline burning engines, among others. The exhaust system 100 and the engine 150 are included in a vehicle 160.

Exhaust system 100 may includes an exhaust manifold 102 for receiving exhaust gases produced by one or more cylinders of engine 150. An exhaust conduit 104 is in fluidic communication with the exhaust manifold 102. A mixing system 110 is fluidically coupled to the exhaust conduit 104. The mixing system 110 may receive liquid reductant (e.g., a liquid reductant spray) from a reductant injection system 130. A selective catalytic reductant (SCR) catalyst 106 is arranged downstream of the mixing system 110, and a noise suppression device 108 is arranged downstream of catalyst 106. Note that catalyst 106 can include a variety of suitable catalysts for reducing NOx or other products of combustion resulting from the combustion of fuel by engine 150. However, in other examples, the catalyst 106 may be another suitable emission control device.

Additionally, exhaust system 100 may include a plurality of exhaust pipes or passages to enable fluidic communication between various components, such as the catalyst 106 and the noise suppression device 108. For example, as illustrated by FIG. 1, an exhaust passage 120 is in fluidic communication with the catalyst 106 and the noise suppression device 108. Additionally, exhaust passage 121 is in fluidic communication with the mixing system 110 and the catalyst 106. Finally, exhaust gases may be permitted to flow from noise suppression device 108 to the surrounding environment via exhaust passage 122, the flow exiting at a tailpipe. Note that while not illustrated by FIG. 1, exhaust system 100 may include a particulate filter and/or diesel oxidation catalyst arranged upstream or downstream of catalyst 106. Furthermore, it should be appreciated that exhaust system 100 may include two or more catalysts. Still further, it should be appreciated that some of the exhaust passages, such as exhaust passage 120 and exhaust passage 121, may not be included in the exhaust system 100 in other examples.

In some embodiments, mixing system 110 can include a greater cross-sectional area or flow area than upstream exhaust passage 104. Furthermore, the mixing system 110 may include a number of features that promote mixing of the reductant in the exhaust stream, thereby improving operation of the catalyst 106, as described herein with regard to FIGS. 2-9 and 11.

An injector 132 is coupled to the mixing system 110. The injector 132 is included in the liquid reductant injection system 130. As one non-limiting example, the liquid injected by the injector 132 may include a liquid reductant solution 134, such as a urea solution. In one specific example, the liquid reductant solution comprises an aqueous urea and ethanol solution. In some examples, the injector 132 may have an integrated valve for regulating the flow of reducant through the injector controlled by controller 195. However, in other examples, a separate valve may be provided upstream of the injector 132 and downstream of the filter 135 to regulate the flow of reducant through the injector 132.

The liquid reductant solution 134 may be supplied to injector 132 through a conduit 136 from a storage tank 138 via a pump 139. The pump 139 is coupled to the conduit 136 for transporting the liquid reductant solution 134 to the injector 132, where the liquid reductant is injected into the exhaust gas flow path as a reductant spray (see FIG. 4, for example).

The conduit 136 includes a filter 135 configured to remove unwanted particulates from the reductant solution traveling through the conduit 136 to the injector 132. The pump 139 includes a pick-up tube 140 extending towards a bottom of the storage tank 138. The pick-up tube 140 includes an inlet 141 configured to receive reductant solution from the storage tank 138.

The reductant injection system 130 further includes a pressure sensor 142. Controller 195 is also included in vehicle 160. The controller 195 may be configured to control a number of components such as the injector 132 and pump 139. For example, the controller 195 may be configured initiate injection of reductant into the mixing system 110 from injector 132 for a specified duration at a specified time responsive to operating parameters.

FIG. 2 shows a perspective view of an example mixing system 110. The mixing system 110 includes a housing 200 defining a boundary of a mixing conduit 202. Housing 200 includes an inner wall interfacing with various components, as will be described. The housing 200 may be constructed out of a suitable material such as a metal (e.g., steel, aluminum), a polymeric material, etc. The housing 200 includes an expansion section 210. Thus, the cross-sectional area spanning the housing 200 perpendicular to the central axis 250 of mixing system 110 increases in a downstream direction in the expansion section 210. Thus, the outlet of the expansion section 210 has a larger cross-sectional area than the cross-sectional area of the inlet of the expansion section. As a result, the expansion section 210 may decrease the speed of the exhaust gas as well as increase the turbulence. The central axis 250 extending from the expansion section 210 to the helical mixing element 222, discussed in greater detail herein, is substantially straight in the depicted example. However, the central axis 250 may have other geometries in other examples. The mixing system 110 includes an inlet 204 in fluidic communication with at least one cylinder in the engine 150, shown in FIG. 1.

The mixing system 110 further includes an outlet 206 in fluidic communication with catalyst 106, shown in FIG. 1. The mixing system 110 further includes a reductant diverter 212 positioned in the expansion section 210. The diverter 212 includes a planar external surface 213 in the depicted example. However, other geometries have been contemplated. Furthermore, the reductant diverter 212 is coupled to a portion of the housing in the expansion section 210 as well as positioned within the housing 200. The reducant diverter may be positioned upstream of a nozzle (not shown) of the injector 132, shown in FIG. 1. An injector mount 214 is coupled to an exterior surface of the housing 200 in the expansion section 210 and may be configured to receive the injector 132, shown in FIG. 1. Specifically, a nozzle of the injector 132 may extend into the mixing conduit 202. The injector mount 214 may be attached to the housing 200 via a suitable technique such as welding, bolting, etc. The diverter 212 increases the turbulence of the exhaust gas and the reductant spray from injector 132, to promote mixing. Further, the flow motion created by the diverter, in combination with the expansion region, better prepares the incoming flow for interaction with the reductant spray and an atomizer 216 so that the gasses can then be rotated via the double helix mixing element 222. As a result, operation of the downstream catalyst may be improved.

As shown in FIG. 2, the mixing system 110 includes the atomizer 216 positioned within the housing 200. Specifically, the atomizer 216 is positioned at an outlet termination of the expansion section 210, the outlet larger than an inlet of the expansion section. The atomizer 216 may be configured to decrease the size of the reductant vapor particles traveling through the mixing system 110. As a result, operation of the downstream catalyst may be improved. The atomizer is positioned downstream of the diverter 212 in the depicted example. The atomizer 216 includes two support extensions 260 fully spanning the housing 200, in that extensions form a chord of the circular cross-section of the exhaust housing 200 on each side of the atomizer. The free space on the sides of the atomizer is in some respects a result of the improved manufacturability of the atomizer using the side supports, in that the atomizer can be self-supporting inside the housing without requiring complex manufacturing, where angled ends of the side supports are in face-sharing contact with the inside wall of the housing 200 via a press-fit. However, an unexpected benefit of the design with the semi-circular sections formed by the chordal position of the support extensions is that the fins (discussed further below) of the atomizer interact with substantially the entire spray from the injector, as little to no spray hits the atomizer to the outsides of the support extensions. In this way, the spaces outside the support extensions can be relatively unencumbered with fins, thus reducing backpressure and flow resistance of the mixing system, while also improving manufacturability and assembly, along with durability.

Continuing with the atomizer 216, it further includes fins 220 laterally extending between the support extensions 260. A lateral axis 290 is provided for reference. The fins 220 are depicted as only partially extending across the mixing conduit 202. Thus, the fins 220 do not fully span across the housing 200. Additionally, the fins 220 are curved in a center region in that each fin is formed by bending it from the vertical position downward and forward. The fins are shown vertically aligned, in that each fin is positioned vertically atop the fins below it. Thus, each of the fins 220 is bent from vertical to flat along a lateral direction. However, other fins geometries have been contemplated. Each of the fins 220 also includes reinforcing a rib 262 extending along the fin longitudinally with respect to the exhaust passage. The reinforcing ribs 262 increase the cross-sectional area moment of inertia of a portion of the fins 220. The reinforcing ribs provide increased structural integrity to the fins 220 as well as increase turbulence in the mixing conduit 202. The top and bottom external surfaces of the fins 220 are generally parallel to the central axis 250.

A helical mixing element 222 is also included in the mixing system 110. The helical mixing element 222 is positioned downstream of the atomizer 216. However, other arrangements have been contemplated. The helical mixing element 222 is also positioned downstream of the diverter 212 and the expansion section 210. The helical mixing element 222 is positioned within the housing 200 and configured to increase the turbulence in the exhaust gas and reductant spray passing through the mixing system 110, thereby improving operation of a downstream catalyst. The helical mixing element 222 may include two or more intertwined helixes, for example forming a double-helix-shaped mixing element. The helical mixing element 222 is fixed in position with regard to the housing 200. In some examples, the helical mixing element 222 may be press fit into the housing 200. However, other attachment techniques may be used in other examples.

In the example shown in FIG. 2, the helical mixing element 222 includes a first helical mixing surface 224 extending axially through a portion of the housing 200. The helical mixing element further includes a second helical mixing surface 295 that is positioned complementary to the first mixing surface 224, in that each one rotates through a the same number of degrees around the central axis, but positioned 180 degrees apart, where the second helical mixing surface 295 also extends axially through a portion of the housing 200. The first helical mixing surface 224 and the second helical mixing surface 295 also face oncoming exhaust flow.

The periphery 226 of the first helical mixing surface 224 and the periphery 227 of the second helical mixing surface 295 are in face sharing contact with the inside wall of housing 200. Additionally, the first helical mixing surface 224 may be a continuous external surface 228 and the second helical mixing surface 295 also may be a continuous external surface 229. A pitch 280 between of the first helical mixing surface 224 and of the second helical mixing surface 295 may correspond to one another, even if the pitch varies along the central axis to decrease in a downstream direction (e.g., both helixes may have identical, non-linear, pitches). The pitch 280 is defined as an axial distance between a peripheral points on the helix at the same radial position (e.g., at the top of the housing). In one example, the pitch may include the axial distance between a first peripheral point 296 on the first helical mixing surface 224 and a second peripheral point 297 on the second helical mixing surface 295 having the same radial positioned with regard to the central axis 250, as indicated by the double-headed line. A decreasing pitch may promote mixing of the reductant spray and the exhaust gas and enable the inlet and outlet cross-sectional areas of the mixer to be different from one another. However, in other examples, the pitch may decrease and then subsequently increase in a downstream direction, or the pitch may be constant.

Additionally, the first helical mixing surface 224 includes a concave groove 282 spirally extending down the surface. The second helical mixing surface 295 also includes a concave groove 283 spirally extending down the surface. The grooves (282 and 283) are centrally positioned on each of their respective mixing surfaces. However, other groove positions have been contemplated. In the depicted example, the first helical mixing surface 224 and the second helical mixing surface 295 each have substantially constant thicknesses. However, in other examples, the thicknesses may vary. For example, the thicknesses 284 of the first helical mixing surface 224 and/or the second helical mixing surface 295 may decrease in a downstream direction. Cutting plane 270 defines the cross-section shown in FIGS. 3 and 4. Cutting plane 272 defines the cross-section shown in FIG. 5.

FIG. 3 shows a cut-away side view of the mixing system 110 including the housing 200 shown in FIG. 2. The expansion section 210 is conical in the depicted example. However, other geometries of the expansion section have been contemplated.

The diverter 212 and the injector mount 214 are also shown in FIG. 3. As discussed above, the injector mount 214 may receive an injector such as reductant injector 132 shown in FIG. 1. The injector mount 214 is positioned in the expansion section 210 in the depicted example. However, in other examples, the injector mount 214 may be positioned upstream or downstream of the expansion section. A reductant spray 265 is also shown. Specifically, the reductant spray 265 is introduced into the mixing conduit 202 in the expansion section 210 and is aimed partially downstream at an angle relative to central axis 250. The vertical width of the reductant spray 265, in combination with the mounting angle, may be selected to not exceed the uppermost fin and the lowermost fin included in the plurality of fins 220, shown in FIG. 2. A longitudinal width of the spray, in combination with the mounting angle, may also be selected to not exceed the width of the fins. A vertical axis 380 is provided for reference. In one particular example, the vertical width of the reductant spray 265 may be 40°. However, other spray patterns have been contemplated.

It will be appreciated that the reducant spray 265 includes droplets of a reductant. As shown in FIG. 3, the central axis 250 of the mixing system 110 is substantially straight. In this way, the compactness of the mixing system 110 may be increased when compared to other exhaust systems which may include curved and extended mixing conduits.

FIG. 3 also shows the helical mixing element 222 including a central shaft 300 from which the mixing surfaces eminate. The central shaft 300 extends along the central axis 250 in the depicted example. However, in other examples the central shaft 300 may have an alternate position and/or orientation. The first helical mixing surface 224 spirals around the central shaft 300 in a helical manner between the inlet and outlet of the mixer. However, the helical mixing element 222 may have other geometries in other examples. As illustrated in FIG. 3, each of the two helixes rotate through approximately 180 degrees, although the outlet region of each of the first and second external surfaces may continue to rotate but without traversing along the central axis so that the surface ends in a substantially vertical position facing directly upstream. For example, such a shape provides the differential in inlet and outlet cross-sectional areas, as well as non-linearity in pitch in the downstream outlet region of the helical mixer. This can also be seen in FIG. 6, for example, as well as FIGS. 8-9. Such a geometry enables additional flow speed and rotation upon exiting the mixer and before entering a downstream catalyst, thus improving overall conversion efficiency.

The increase in the cross-sectional area of the expansion section 210 is substantially linear in the depicted example. Specifically, in one example, an angle 350 is formed between the intersection of the central axis 250 of the housing and an axis 352 extending down the inner surface of the expansion section 210. Additionally, an angle 360 is also formed between intersection of the central axis 250 and an axis 362 parallel to an outer surface of the diverter 212. Additionally, the diameter 370 of the housing 200 downstream of the expansion section 210 is substantially constant in the depicted example. However, other housing geometries may be used. The first helical mixing surface 224 and the second helical mixing surface 295 are also shown in FIG. 3.

FIG. 4 shows an expanded view of the diverter 212 and the reductant spray 265, shown in FIG. 3. As previously discussed, the reductant spray 265 may be delivered to the mixing conduit 202 via the injector 132, shown in FIG. 1. As shown, the diverter 212 directs exhaust gas adjacent to the upstream boundary of the reductant spray 265. In this way, mixing of the exhaust gas and the reductant spray 265 may be increased in the mixing conduit 202, thereby improving operation of the catalyst 106, shown in FIG. 1. The diversion of exhaust gas into the reductant spray 265 may also assist in reductant evaporation and/or decomposition in the exhaust gas, further improving catalyst operation. Flow channels 400 may be formed between the diverter 212 and the housing 200 to direct the exhaust gas to the upstream boundary of the reductant spray 265. Flow passages 402 may also be included in the injector mount 214 for directing exhaust gas to the upstream boundary of the reductant spray 265. The flow channel 400 may be in fluidic communication with a flow passage 402 in the injector mount 214. Arrows 450 denote the flow of exhaust gas through the flow channels 400 and arrows 452 denote the flow of exhaust gas through the flow passages 402. The diverter 212 also shields the tip of the injector 132, shown in FIG. 1, thereby reducing reductant deposits on the tip of the injector. As shown, the lateral width of the reductant spray 265 does not exceed the width of the fins 220.

FIG. 5 shows another cross-section of the mixing system 110 of FIG. 2. The injector mount 214 and the atomizer 216 are depicted, among other features. As shown, the fins 220 laterally extend between the support extensions 260. The support extensions 260 span the housing 200. The atomizer 216 may also include cross bars 510 which may increase the stiffness of the atomizer 216 reducing bending of the atomizer 216. However, in other examples the atomizer 216 may not include cross bars 510. The atomizer 216 further includes support extensions 514 extending laterally across the housing 200. The lateral axis 290 is provided for reference.

The atomizer 216 may be welded to the housing at interfaces 512, or press-fit at interfaces 512. By maintaining the connection with reduced area contact at interfaces 512, heat loss to the housing 500 may be reduced.

As shown, the fins 220 are twisted and bent such that a portion of the planar external surfaces of the fins are parallel to the central axis 250. It will be appreciated that the twisted fins 220 increase the turbulence in the exhaust gas as well as simplify the manufacturing cost when compared to more complex designs. The fins 220 are also curved upward at the connection edges of the supports in an upwardly direction relative to a vertical axis 550, provided for reference.

It will be appreciated that when the atomizer 216 enables exhaust gas to flow between the support extensions 260 and the housing 200 via openings 520, the back pressure of the mixing system 110 is reduced, thereby improving engine operation.

Figure 6:
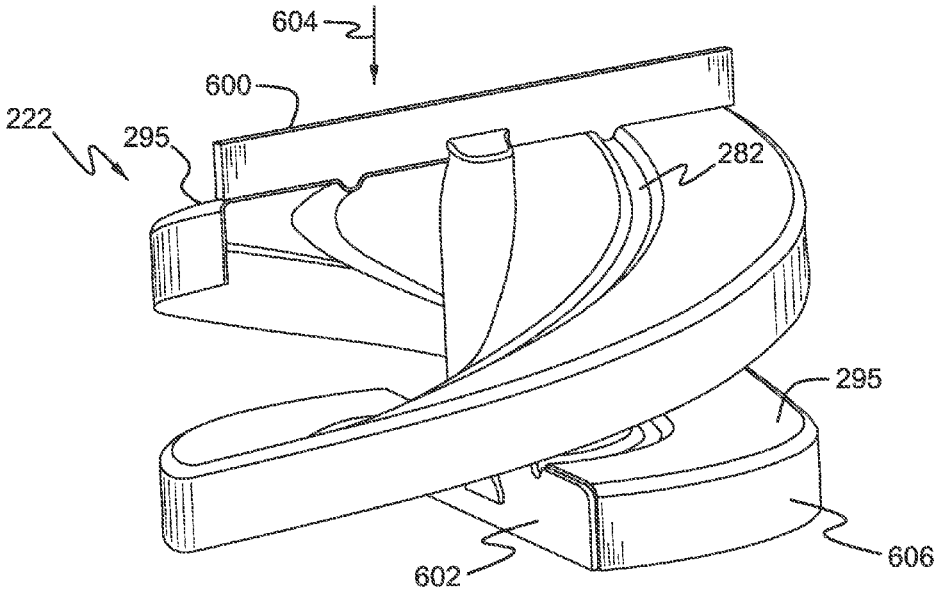
FIG. 6 shows an expanded view of the helical mixing element shown in FIG. 2.

FIG. 6 shows an expanded view the helical mixing element 222 shown in FIG. 2. The first helical mixing surface 224 and the second helical mixing surface 295 are depicted. The helical mixing element 222 also includes a front brace 600 forming a leading edge, and a rear brace 602 forming a trailing edge. The leading edge divides incoming exhaust flow into two flows, one for each of the helixes in the helical mixing element 222. The helical mixing element 222 is formed by the various walls to generate a hollow body of the mixer.

Arrow 604 denotes the general flow of exhaust gas through the mixing conduit 202, shown in FIG. 2. The front brace 600 and the rear brace 602 may extend fully across the mixing conduit 202, shown in FIG. 2. The concave groove 282 is also shown in the helical mixing element 222 in FIG. 6. The helical mixing element 222 shown in FIG. 6 further includes a lip flange 606. The lip flange 606 enables the helical mixing element 222 to be spot welded or press-fit to the housing 200, shown in FIG. 2. However, other attachment techniques of the helical mixing element to the housing have been contemplated.

Figure 7:
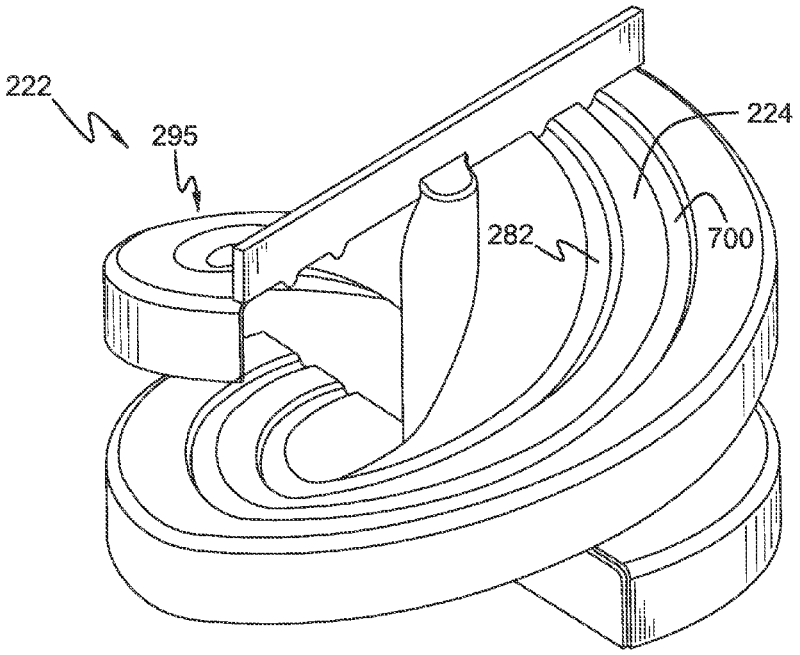
FIG. 7 shows another example helical mixing element.

FIG. 7 shows another example of helical mixing element 222 having a second concave groove 700, but otherwise having a similar geometry. The second concave groove 700 is similar to the first concave groove 282 in the first helical mixing surface 224, but positioned further away from the central axis. Specifically, lines tangent to the curve of the concave grooves (282 and 700) may be substantially parallel. The concave grooves (282 and 700) increase the stiffness of the helical mixing element 222. It will be appreciated that the second helical mixing surface 295 may also include similar grooves.

Figure 8:
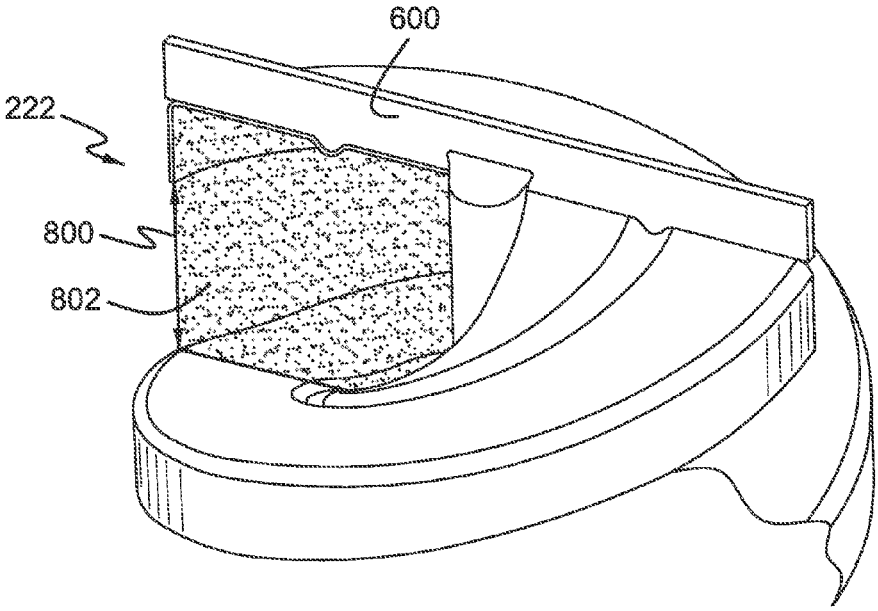
FIGS. 8 and 9 show additional views of the helical mixing element shown in FIG. 6.
Figure 9:
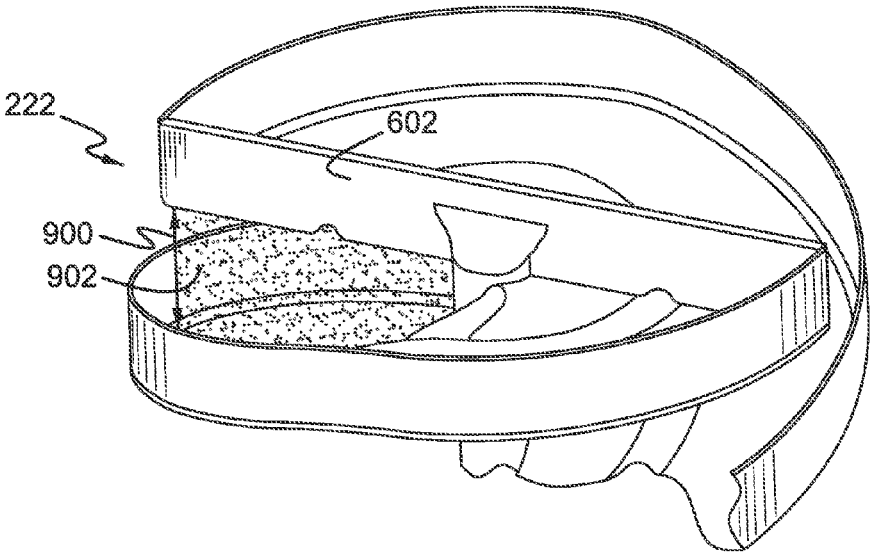
Figure 10:
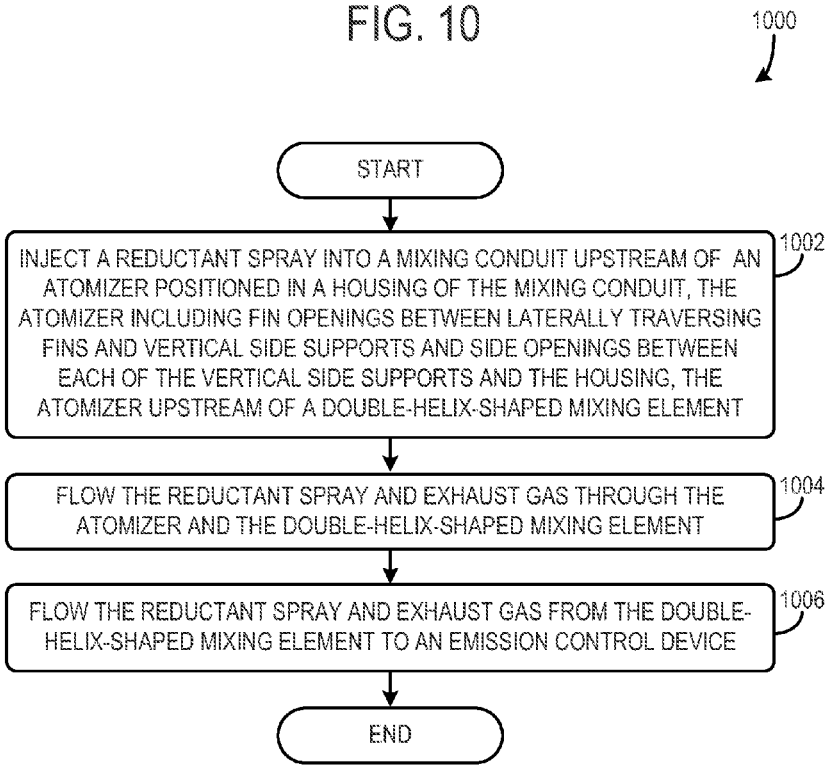
FIG. 10 shows a method for operation of an exhaust system.

FIGS. 8 and 9 show additional views of the helical mixing element 222. Specifically, FIG. 8 shows the front brace 600 of the helical mixing element 222 as well as the first mixing surface 224 and the second mixing surface 295. On the other hand, FIG. 9 shows the rear brace 602 of the helical mixing element 222 as well as the first mixing surface 224 and the second mixing surface 295. The upstream pitch 800 at the inlet of the helical mixing element 222, shown in FIG. 8, is greater than the downstream pitch 900 at the outlet of the helical mixing element, shown in FIG. 9. Thus, the pitch of the helical mixing element 222 decreases in a downstream direction, thereby increasing the flow velocity of the exhaust gas flowing through the helical mixing element. As a result, mixing is further promoted in the helical mixing element 222. It will be appreciated that the double helix in the helical mixing element 222 has a smaller outlet cross-sectional area 802, shown in FIG. 8, than inlet cross-sectional area 902, shown in FIG. 9, due to the decrease in pitch.

FIG. 10 shows a method for operation of an emission system. Method 1000 may be implemented by systems and components described above with regard to FIGS. 1-9 and 11 or may be implemented by other suitable systems and components.

At 1002 the method includes injecting a reductant spray into a mixing conduit upstream of an atomizer positioned in a housing of the mixing conduit, the atomizer including fin openings between laterally traversing fins and vertical side supports and side openings between each of the vertical side supports and the housing, the atomizer upstream of a double-helix-shaped mixing element. In some examples, the reductant may be sprayed into the exhaust conduit downstream of a reductant diverter extending into the conduit upstream of the injector mount.

At 1004 the method includes flowing the reductant spray and exhaust gas through the atomizer and the double-helix-shaped mixing element and at 1006 the method includes flowing the reductant spray and exhaust gas from the double-helix-shaped mixing element to an emission control device. As discussed above the reductant may be sprayed into the exhaust conduit upstream of a reductant diverter extending into the conduit upstream of the injector mount and the reductant may be sprayed into an expansion section in the mixing conduit.

Figure 11:
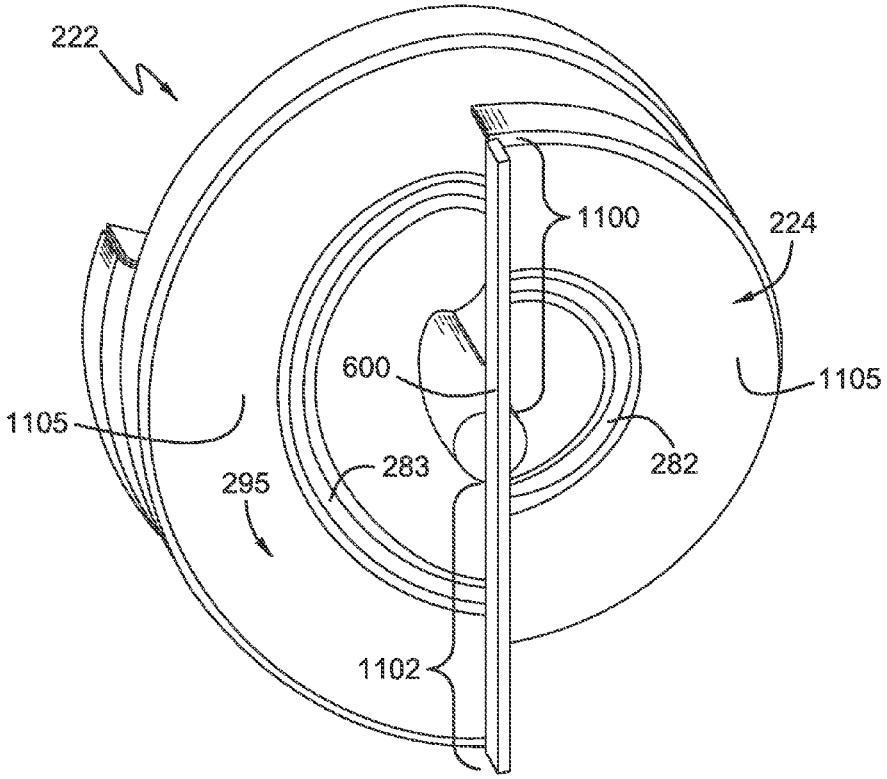
FIG. 11 shows the helical mixing element included in the mixing system shown in FIG. 2.

FIG. 11 shows another view of the helical mixing element 222. The first helical mixing surface 224 and the second helical mixing surface 295 of the helical mixing element 222 are depicted in FIG. 11. As shown, the first helical mixing surface 224 extends from a first side 1100 of the front brace 600. On the other hand, the second helical mixing surface 295 extends from a second, opposite, side 1102 of the front brace 600, but with both surfaces positioned and shaped to rotate incoming flow in the same direction. As previously discussed, the pitch between the first helical mixing surface 224 and the second helical mixing surface 295 may decrease in a downstream direction, for example at the outlet exit, where the pitch is constant for approximately 180 degrees of rotation for each of the surfaces, but then decreases for a remaining 100 degrees of rotation. The groove 282 in the first helical mixing surface 224 and the groove 283 in the second helical mixing surface 295 are also depicted.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A mixing system, comprising:

a housing defining a boundary of a mixing conduit including an expansion section with an injector mount;

a reductant diverter extending into the mixing conduit upstream of the injector mount in the expansion section;

an atomizer with openings positioned in the housing; and a helical mixing element positioned in the housing including a double helix with smaller outlet cross-sectional area than inlet cross-sectional area.

2. The mixing system of claim 1, where the helical mixing element is press fit into the housing, and where the atomizer is positioned downstream of the expansion section.

3. The mixing system of claim 1 , where the helical mixing element is positioned downstream of the atomizer, the helical mixing element including a leading front brace having a leading edge dividing incoming flow into two flows, one for each of the helixes.

4. The mixing system of claim 1, where the atomizer includes fins extending between a first and a second support extension without fully spanning across the housing, the atomizer positioned at an outlet termination of the expansion section, the outlet termination larger than an inlet of the expansion section.

5. The mixing system of claim 4, where the fins are curved in a downstream direction.

6. The mixing system of claim 4, wherein the helical mixing element is positioned downstream of the atomizer.

7. The mixing system of claim 4, where the fins are aligned and parallel with one another.

8. The mixing system of claim 1, where the helical mixing element includes a first helical mixing surface and a second helical mixing surface, each of the surfaces spirally extending axially through a portion of the housing.

9. The mixing system of claim 8, where a periphery of the first and second helical mixing surfaces are each in face sharing contact with a portion of the housing and each includes a continuous external surface.

10. The mixing system of claim 8, where a pitch between the first and second helical mixing surfaces decreases in a downstream direction.

11. The mixing system of claim 8, where at least one of the first and second helical mixing surfaces includes a concave groove spirally extending down the surface.

12. A system, comprising:

a mixing conduit housing including an expansion section having an injector mount;

a reductant diverter upstream of the injector mount angled parallel with the housing in the expansion section;

an atomizer downstream of the expansion section including fins extending only between a first and a second support extension and not fully spanning the housing; and a double-helix-shaped mixing element having unequal inlet and outlet cross-sectional areas, and positioned downstream of the atomizer, where helical mixing surfaces of the double-helix-shaped mixing element facing oncoming flow have a central groove.

13. The system of claim 12, where the fins are vertically aligned, each fin bent from vertical to longitudinal along a lateral direction.

14. The system of claim 12, where the double-helix-shaped mixing element includes a first helical mixing surface and a second helical mixing surface, each of the helical mixing surfaces spirally extending axially through a portion of the housing with a pitch of the helical mixing surfaces decreasing in a downstream direction.

15. A system, comprising:

a mixing conduit housing including an expansion section having an injector mount;

a reductant diverter upstream of the injector mount angled parallel with the housing in the expansion section;

an atomizer downstream of the expansion section including fins extending only between a first and a second support extension and not fully spanning the housing; and a double-helix-shaped mixing element having unequal inlet and outlet cross-sectional areas, and positioned downstream of the atomizer, where the double-helix-shaped mixing element includes a first helical mixing surface and a second helical mixing surface, each of the helical mixing surfaces spirally extending axially through a portion of the housing with a pitch of the helical mixing surfaces decreasing in a downstream direction.

16. The system of claim 15, where helical mixing surfaces of the double-helix-shaped mixing element facing oncoming flow have a central groove.

17. The system of claim 15, where the fins are vertically aligned, each fin bent from vertical to longitudinal along a lateral direction.

* * * * *